US011110333B2

(12) United States Patent
Stikeleather

(10) Patent No.: US 11,110,333 B2
(45) Date of Patent: Sep. 7, 2021

(54) GAME OF TOSS

(71) Applicant: Edward R. Stikeleather, Medfield, MA (US)

(72) Inventor: Edward R. Stikeleather, Medfield, MA (US)

( * ) Notice: Subject to any disclaimer, the term of this patent is extended or adjusted under 35 U.S.C. 154(b) by 0 days.

(21) Appl. No.: 16/609,128

(22) PCT Filed: Apr. 28, 2018

(86) PCT No.: PCT/US2018/030052

§ 371 (c)(1),
(2) Date: Oct. 28, 2019

(87) PCT Pub. No.: WO2018/201110

PCT Pub. Date: Nov. 1, 2018

(65) Prior Publication Data

US 2020/0179779 A1 Jun. 11, 2020

Related U.S. Application Data

(60) Provisional application No. 62/492,088, filed on Apr. 28, 2017.

(51) Int. Cl.

| | |
|---|---|
| ***A63B 67/06*** | (2006.01) |
| ***A63B 47/02*** | (2006.01) |
| ***A63B 63/08*** | (2006.01) |

(52) U.S. Cl.

CPC ..... *A63B 67/06* (2013.01); *A63B 47/02* (2013.01); *A63B 63/08* (2013.01); *A63B 2209/10* (2013.01)

(58) Field of Classification Search

CPC ..... A63B 67/06; A63B 47/02; A63B 63/00; A63B 63/08; A63B 2209/10; A63F 9/02; A63F 9/0204

USPC ..... 273/118 R, 127 R, 127 B, 127 D, 126 R, 273/348, 400, 401, 402, 390

See application file for complete search history.

(56) References Cited

U.S. PATENT DOCUMENTS

| | | | | | |
|---|---|---|---|---|---|
| D33,153 | S | | 9/1900 | Cornell | |
| 1,114,523 | A | | 10/1914 | Revell | |
| 1,295,437 | A | * | 2/1919 | Cogswell | A63F 7/305 273/127 D |
| D91,034 | S | | 11/1933 | Kirk | |
| 2,666,642 | A | * | 1/1954 | Ward | A63F 9/0204 273/336 |

(Continued)

OTHER PUBLICATIONS

International Search Report and Written Opinion dated Jul. 26, 2018 in corresponding PCT Patent Application No. PCT/US18/30052.

(Continued)

*Primary Examiner* — Raleigh W Chiu

(74) *Attorney, Agent, or Firm* — Grossman, Tucker, Perreault & Pfleger, PLLC

(57) ABSTRACT

A scoring receptacle for a game of toss may include a first receptacle having at least one first receptacle sidewall. The at least one first receptacle sidewall may define a first receptacle cavity. The scoring receptacle may also include a second receptacle having at least one second receptacle sidewall. The at least one second receptacle sidewall may define a second receptacle cavity. The second receptacle may be configured to be disposed within the first receptacle cavity. A position of the second receptacle relative to the first receptacle may be adjustable.

10 Claims, 16 Drawing Sheets

(56) References Cited

U.S. PATENT DOCUMENTS 3,244,420 A * 4/1966 Poynter ..... A63B 63/083 273/402
3,306,615 A * 2/1967 Tack ..... A63F 9/0204 273/400
3,464,704 A * 9/1969 Nelson ..... A63B 67/02 473/162
D222,945 S 2/1972 Knox
3,790,174 A * 2/1974 Skillern ..... F41J 13/02 273/394
D248,680 S 7/1978 Waski
4,392,653 A * 7/1983 Blume, Sr. ..... A63B 67/06 273/400
4,877,256 A * 10/1989 Falloon ..... A63B 67/06 273/400
4,982,966 A * 1/1991 Teafatiller ..... A63B 67/06 273/336
5,040,801 A * 8/1991 Weymuth ..... A63B 67/06 273/338
5,052,693 A * 10/1991 Hicks ..... A63B 67/06 273/336
5,123,656 A * 6/1992 Green ..... A63B 67/06 273/400
5,290,040 A * 3/1994 Boroski ..... A63B 67/06 273/348.4
D375,529 S * 11/1996 Kohler ..... A63B 63/083 D21/303
D378,687 S 4/1997 Clark
5,732,952 A * 3/1998 Joseph ..... A63B 63/08 273/317.6
D479,279 S 9/2003 Kessler, Jr. et al.
6,843,478 B1 1/2005 Hoepelman
7,066,824 B2 * 6/2006 Wenzler ..... A63B 69/3623 273/400
7,134,662 B2 * 11/2006 Menendez ..... A63B 67/06 273/400
D533,599 S 12/2006 Bolter
D627,833 S 11/2010 Willis
D691,660 S * 10/2013 Shea ..... A63F 9/0204 D21/303
9,248,357 B2 * 2/2016 Francis ..... A63B 67/06
9,707,461 B1 * 7/2017 McKnight ..... A63B 67/06
9,827,474 B2 * 11/2017 Sciandra ..... A63B 63/00
10,137,360 B2 11/2018 Sciandra
2006/0066054 A1 * 3/2006 Menendez ..... A63B 67/06 273/348
2006/0119031 A1 6/2006 Riley et al.
2008/0265719 A1 10/2008 deMange
2013/0093139 A1 * 4/2013 Shea ..... A63B 71/0036 273/354
2015/0069708 A1 * 3/2015 Mashburn ..... A63B 67/06 273/400
2015/0115532 A1 * 4/2015 Martinson ..... A63B 67/06 273/400
2015/0246280 A1 * 9/2015 Shea ..... A63F 9/0204 273/350
2016/0101334 A1 * 4/2016 Worthy ..... A63B 67/002 273/401
2020/0147466 A1 5/2020 Heinrich

OTHER PUBLICATIONS

Notice of Allowance dated Jun. 24, 2020 in related U.S. Appl. No. 29/621,696.

* cited by examiner

GAME OF TOSS

PRIORITY CLAIM

This application claims the benefit of U.S. Provisional Patent Application Ser. No. 62/492,088 filed on Apr. 28, 2017, entitled Game of Toss, which is fully incorporated herein by reference.

FIELD

The present disclosure relates generally to games of skill and more particularly to a game of toss.

BACKGROUND

Games of skill may involve one or more players exhibiting mental or physical skill to achieve a stated goal (e.g., obtain a certain number of points). In some instances, the goal may involve the tally of points based on a player accomplishing a predetermined task or objective in the game. When the player achieves a predetermined number points, that player may be determined the winner. Some games of skill involve the throwing of one or more objects (e.g., darts).

BRIEF DESCRIPTION OF THE DRAWINGS

Features and advantages of the present disclosure will be apparent from the following description of embodiments consistent therewith, which description should be considered in conjunction with the accompanying drawings, wherein.

DESCRIPTION

A game of toss may include a projectile, a first receptacle, and a second receptacle disposed within the first receptacle, the first and second receptacles for receiving the projectile. The game of toss may involve a player throwing the projectile from a starting position in a direction of the first and second receptacles. Once thrown, the projectile may land in a location external to both the first and second receptacles, at a location within the first receptacle but external to the second receptacle, or at a location within both the first and second receptacles. A scoring system may be devised based on where the projectile lands relative to the first and second receptacles. To change the difficulty of the game of toss, the location of the second receptacle within the first receptacle may be adjusted. For example, the second receptacle may be moved from a central position toward a rearward position such that a separation distance between the player and the second receptacle is increased.

Figure 1:
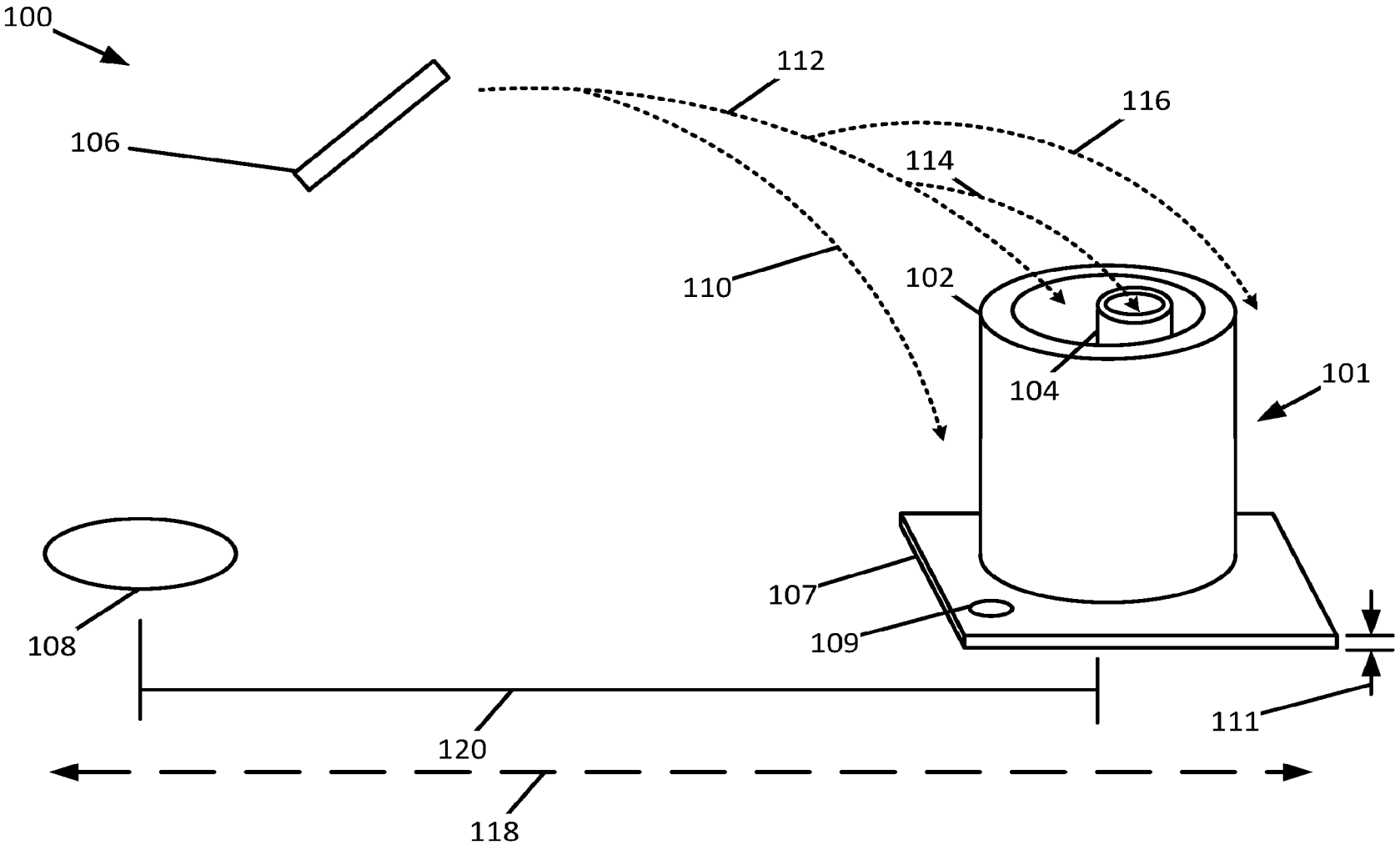
FIG. 1 shows a schematic perspective view of an example of a game of toss, consistent with embodiments of the present disclosure.

FIG. 1 shows a schematic example of a game of toss 100. As shown, the game of toss may include a scoring receptacle 101 and at least one projectile 106. The scoring receptacle may include a first receptacle 102 and a second receptacle 104, the second receptacle 104 being configured to be received within the first receptacle 102. The second receptacle 104 may be disposed within the first receptacle 102. The projectile 106 may be thrown (e.g., by a player) from a starting position 108 in a direction of the first and second receptacles 102 and 104. The starting position 108 may represent the minimum distance to the scoring receptacle 101 a player may be before throwing the projectile 106. In some instances, the starting position 108 may represent the location at which the player stands before throwing the projectile 106.

As shown, once thrown the projectile 106 may follow one of a plurality of trajectories. For example, the projectile 106 may follow a first trajectory 110, a second trajectory 112, a third trajectory 114, or a fourth trajectory 116. When the projectile 106 follows the first and fourth trajectories 110 and 116, the projectile 106 lands at a location external to both of the first and second receptacles 102 and 104. When the projectile 106 follows the second trajectory 112, the projectile 106 lands within the first receptacle 102 and external to the second receptacle 104 and, when the projectile 106, follows the third trajectory 114, the projectile lands within both the first and second receptacles 102 and 104. The location at which the projectile 106 lands may be used as the basis for a scoring system. For example, when the projectile 106 lands external to the first and second receptacles 102 and 104, a player may be awarded one point, when the projectile 106 lands within the first receptacle 102 but external to the second receptacle 104, a player may be awarded three points, and when the projectile 106 lands within both the first and second receptacles 102 and 104, a player may be awarded six points.

In some instances, the scoring receptacle 101 may be placed on a mat 107 defining one or more scoring regions external to the first and second receptacles 102 and 104. The mat 107 may include one or more openings 109 extending through the mat 107. The openings 109 may be configured to receive at least a portion of the projectile 106 such that, in some instances, when the projectile lands on the mat 107 the projectile 106 extends from the mat 107. Therefore, when the projectile 106 lands on the mat 107 the scoring may be based, at least in part, on where the projectile 106 lands on the mat 107 and/or whether or not the projectile 106 is received at least partially within a respective opening 109. Additionally, or alternatively, the mat 107 may be formed of a material capable of being at least partially punctured by at least a portion of the projectile 106 in response to the projectile 106 landing on the mat 107 in a particular orientation. In these instances, the projectile 106 may extend from the mat 107 when the projectile 106 punctures the mat 107.

The openings 109 may have any shape including, for example, a circular shape, square shape, octagonal shape, triangular shape, and/or any other suitable shape. A largest dimension of the opening 109 may measure, for example, in a range of 6.35 millimeters (mm) to 12.7 mm. By way of further example, a largest dimension of the opening 109 may measure in a range of 10.5 mm to 11.5 mm. A thickness 111 of the mat 107 may, for example, measure in a range of 10 mm to 30 mm. By way of further example, the thickness 111 of the mat 107 may measure in a range of 15 mm to 25 mm. In some instances, the thickness 111 of the mat 107 may measure in a range of 1 mm to 2 mm. In these instances, the mat 107 may not include the one or more openings 109.

In some instances, the mat 107 may comprise multiple interconnecting segments (e.g., 2, 3, 4, 5, 6, or more parts) such that the mat 107 can be assembled and disassembled. For example, each individual segment of the mat 107 may be sized such that each part of the mat 107 can be disposed within the first receptacle 102. For example, the mat 107, the projectile(s) 106, and the second receptacle 104 can each be simultaneously disposed within the first receptacle 102. This may make transport of the game of toss 100 easier. In some instances, the mat 107 (or the segments of the mat 107) may be flexible.

To change the difficulty of the game of toss 100, the position of the second receptacle 104 relative to, for example, the first receptacle 102 and/or the starting position 108 may be adjusted. For example, the second receptacle 104 may be moved along a throwing axis 118 relative to the first receptacle 102 such that a separation distance 120 between the second receptacle 104 and the starting position 108 may be increased or decreased. In other words, the position of the second receptacle 104 within the first receptacle 102 may be adjusted (e.g., changed). As the second receptacle 104 is moved along the throwing axis 118 in a direction of the starting position 108, it may become more difficult to successfully throw the projectile 106 into the second receptacle 104. For example, the steepness of the throwing trajectory 114 of the projectile 106 may need to be increased to successfully throw the projectile 106 into the second receptacle 104.

Figure 2:
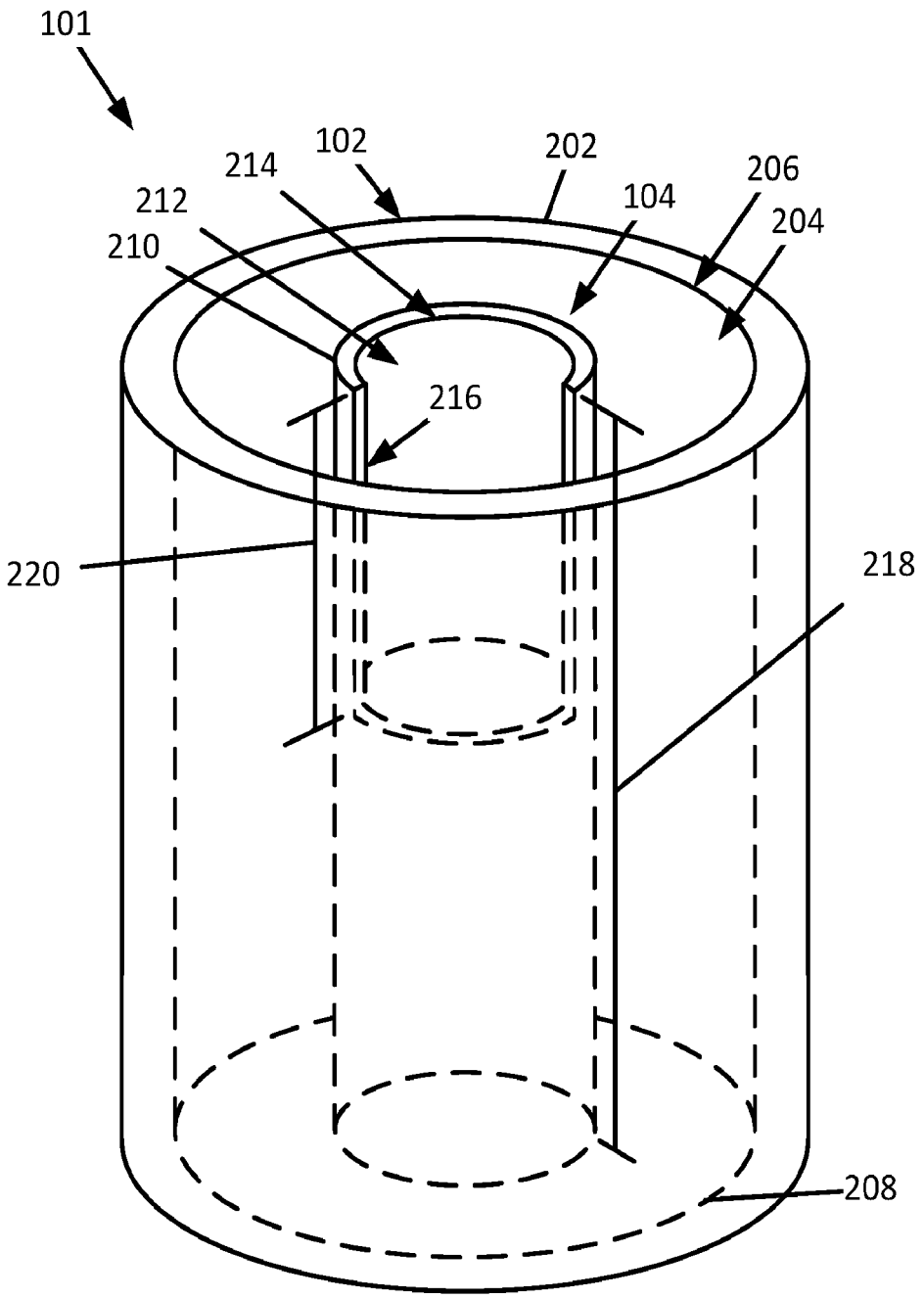
FIG. 2 shows a schematic perspective view of a scoring receptacle having a first and second receptacle that may be used in the game of toss of FIG. 1, consistent with embodiments of the present disclosure.

FIG. 2 shows a schematic example of the scoring receptacle 101. As shown, the first receptacle 102 may include one or more first receptacle sidewalls 202 that define a first receptacle cavity 204 having a first receptacle scoring end 206. The first receptacle scoring end 206 being an open end for receiving, for example, the projectile 106. In some instances, the first receptacle sidewall 202 may extend from a base 208 such that the first receptacle scoring end 206 of the first receptacle cavity 204 is opposite the base 208. In other words, the first receptacle 102 may generally be described as being, for example, a bucket. In other instances, the first receptacle 102 may not include the base 208. For example, the base 208 may be the surface (e.g., a floor) on which the first receptacle 102 is placed. In this instance, the first receptacle 102 may generally be described as being a body having two opposing open ends.

The second receptacle 104 may include one or more second receptacle sidewalls 210 that define a second receptacle cavity 212 having a second receptacle scoring end 214. The second receptacle scoring end 214 being an open end for receiving, for example, the projectile 106. As shown, the second receptacle sidewall 210 may extend from the base 208 of the first receptacle 102 in a direction of the first receptacle scoring end 206. In other words, the second receptacle scoring end 214 is opposite the base 208. The second receptacle 104 may include a cutout 216 that extends into the second receptacle cavity 212. As shown, the cutout 216 may extend from the second receptacle scoring end 214 in a direction of the base 208 for at least a portion of a second receptacle length 218. For example, a ratio of a cutout length 220 to the second receptacle length 218 may be in a range of 4:5 to 1:10. By way of further example, a ratio of the cutout length 220 to the second receptacle length 218 may be in a range of 1:2 to 1:5. Alternatively, the second receptacle 104 may not include the cutout 216.

As the cutout length 220 increases, it may become easier to throw the projectile 106 into the second receptacle 104. For example, increasing the cutout length 220 may decrease the required steepness of the third trajectory 114 required to have the projectile 106 land in the second receptacle 104.

Figure 3:
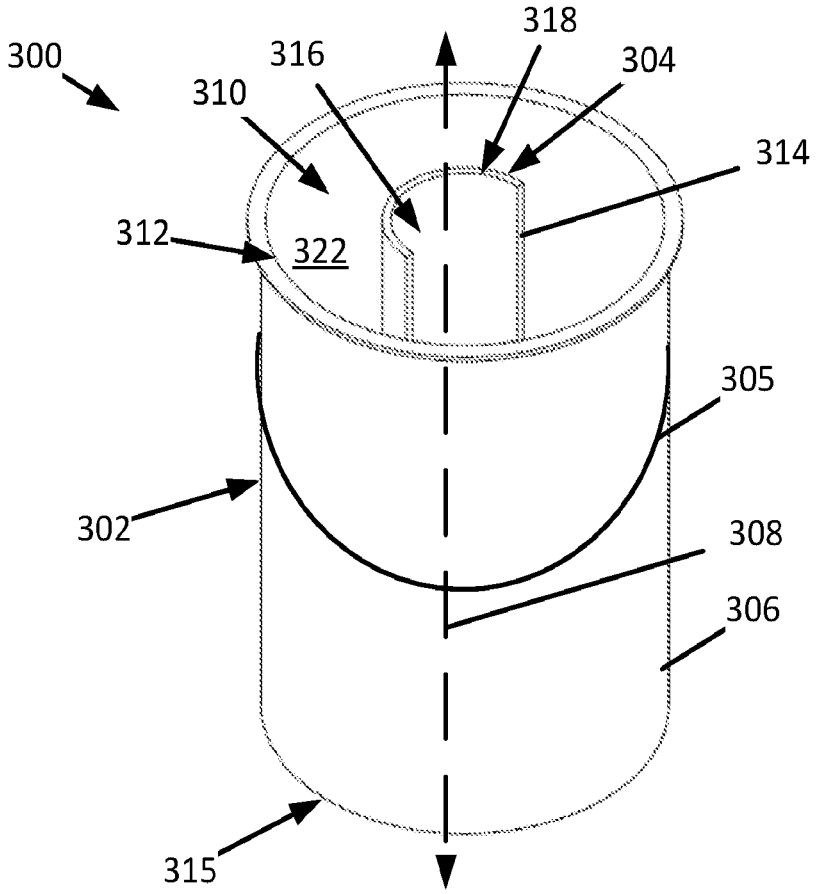
FIG. 3 shows a perspective view of a scoring receptacle having a first and second receptacle, consistent with embodiments of the present disclosure.
Figure 4:
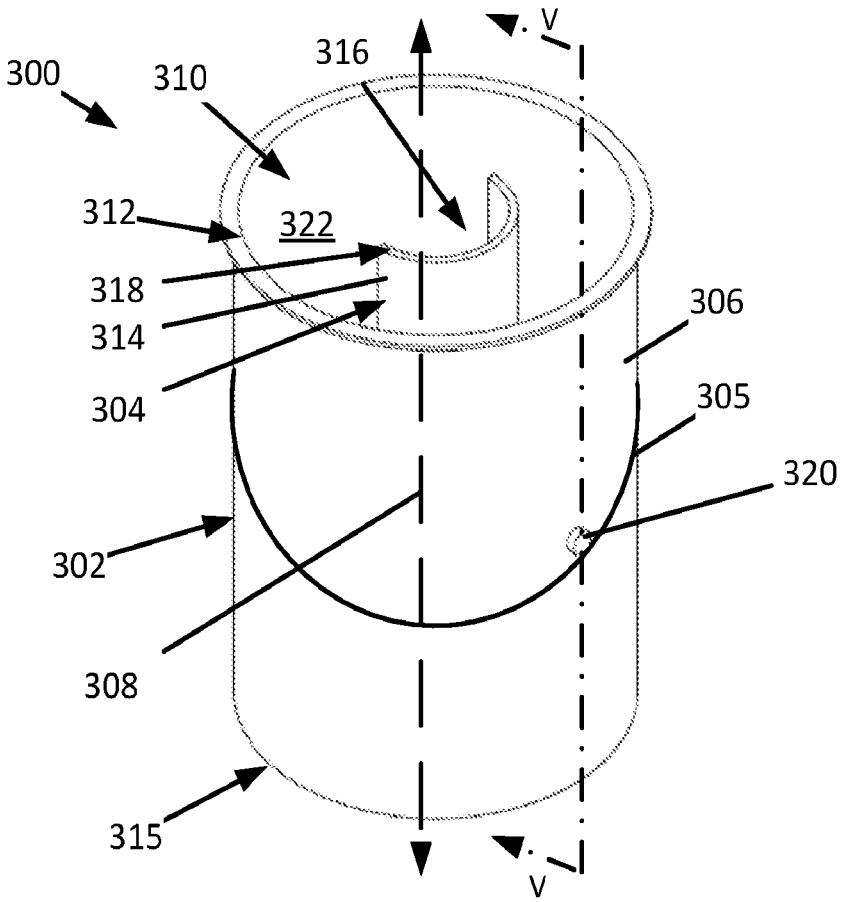
FIG. 4 shows another perspective view of the scoring receptacle of FIG. 3, consistent with embodiments of the present disclosure.

FIGS. 3 and 4 show a perspective view of a scoring receptacle 300, which may be an example of the scoring receptacle 101 of FIG. 1. As shown, the scoring receptacle 300 includes a first receptacle 302 and a second receptacle 304, the second receptacle 304 being configured to be received within the first receptacle 302. In some instances, the scoring receptacle 300 may also include a handle 305. The handle 305 may be coupled to, for example, the first receptacle 302. The handle 305 may be used for carrying the scoring receptacle 300 and, in some instances, the handle 305 may be used when playing the game of toss 100 (e.g., if a projectile, such as the projectile 106, becomes lodged between the handle and the first receptacle 302 a player may obtain extra points).

The first receptacle 302 may include at least one first receptacle sidewall 306 extending along a central axis 308 of the scoring receptacle 300. The first receptacle sidewall 306 may define a first receptacle cavity 310 having a first receptacle scoring end 312. The first receptacle 302 may include a base 315 opposite the first receptacle scoring end 312. Therefore, the first receptacle 302 may generally be described as being a bucket. In some instances, the first receptacle 302 may not include the base 315. For example, the first receptacle 302 may include an open end opposite the first receptacle scoring end 312. Therefore, the open end may be adjacent a surface (e.g., a floor) on which the first receptacle 302 rests. As such, the surface may act as a base.

The second receptacle 304 may be disposed within the first receptacle cavity 310. The second receptacle 304 may include at least one second receptacle sidewall 314. The at least one second receptacle sidewall 314 may define a second receptacle cavity 316 having a second receptacle scoring end 318. The second receptacle scoring end 318 may be opposite the base 315 of the first receptacle 302. As such, the second receptacle sidewall 314 may extend from the base 315 in a direction of the first receptacle scoring end 312. Therefore, the first receptacle scoring end 312 and the second receptacle scoring end 318 may be generally described as being opposite the base 315.

In some instances, the second receptacle 304 may be coupled to the first receptacle 302. For example, the second receptacle 304 may be coupled to the first receptacle 302 using a shaft 320. In other instances, the second receptacle 304 may not be coupled to the first receptacle 302. For example, the second receptacle 304 may include one or more protrusions or enlargements that engage (e.g., contact) an inner surface 322 of the first receptacle 302.

In some instances, the second receptacle 304 may be removable from the first receptacle 302. For example, the second receptacle 304 may be capable of being disposed in multiple different first receptacles 302, each having a different geometry and/or size. By disposing the second receptacle 304 in multiple different first receptacles 302, the difficulty of the game of toss 100 may be changed. Further, in some instances, this may allow a player of the game of toss 100 to avoid transporting the first receptacle 302 and instead use any available receptacle as the first receptacle 302.

Figure 5A:
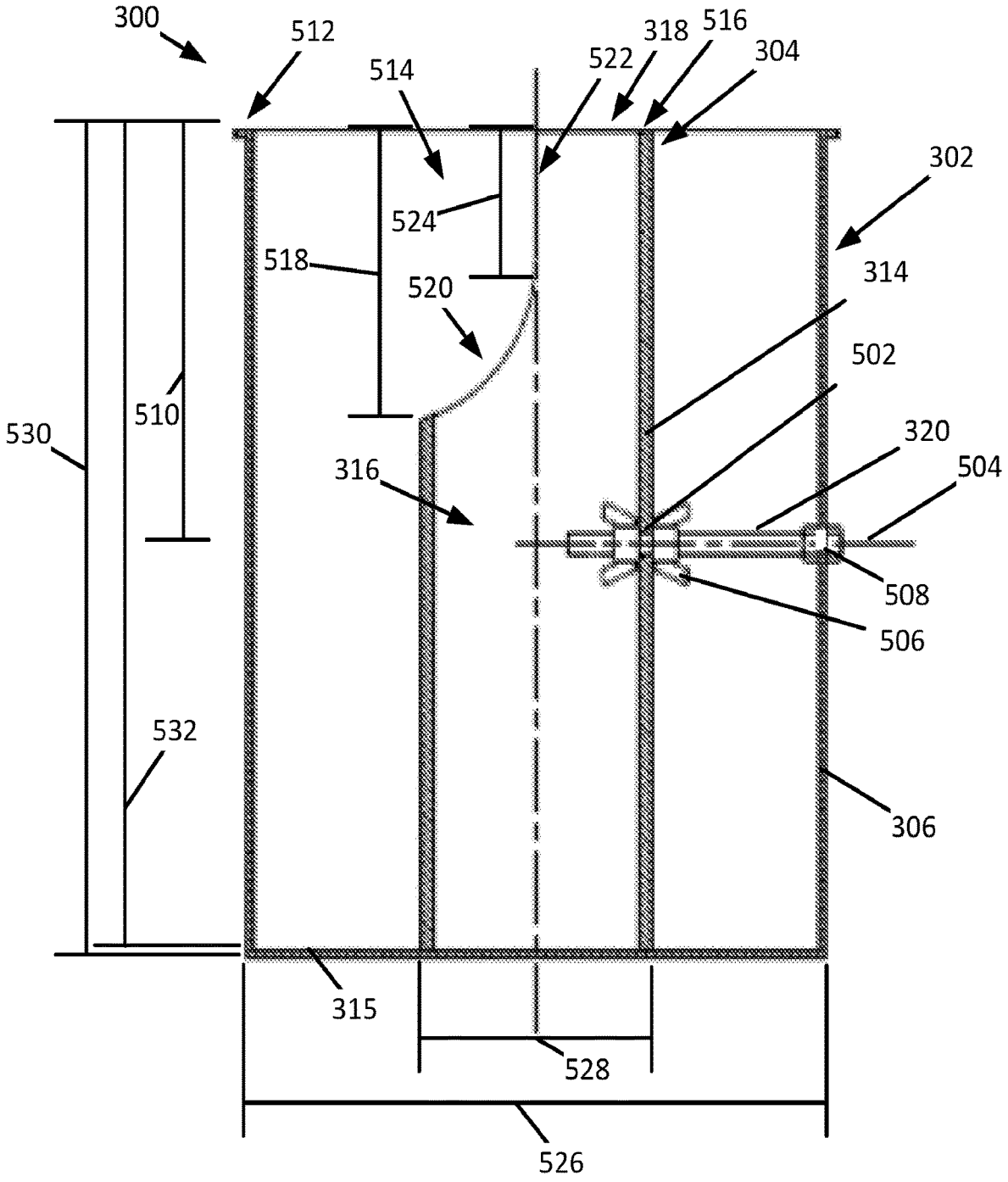
FIG. 5A shows a cross-sectional view the scoring receptacle of FIG. 3 taken along the line V-V of FIG. 4, consistent with embodiments of the present disclosure.
Figure 5B:
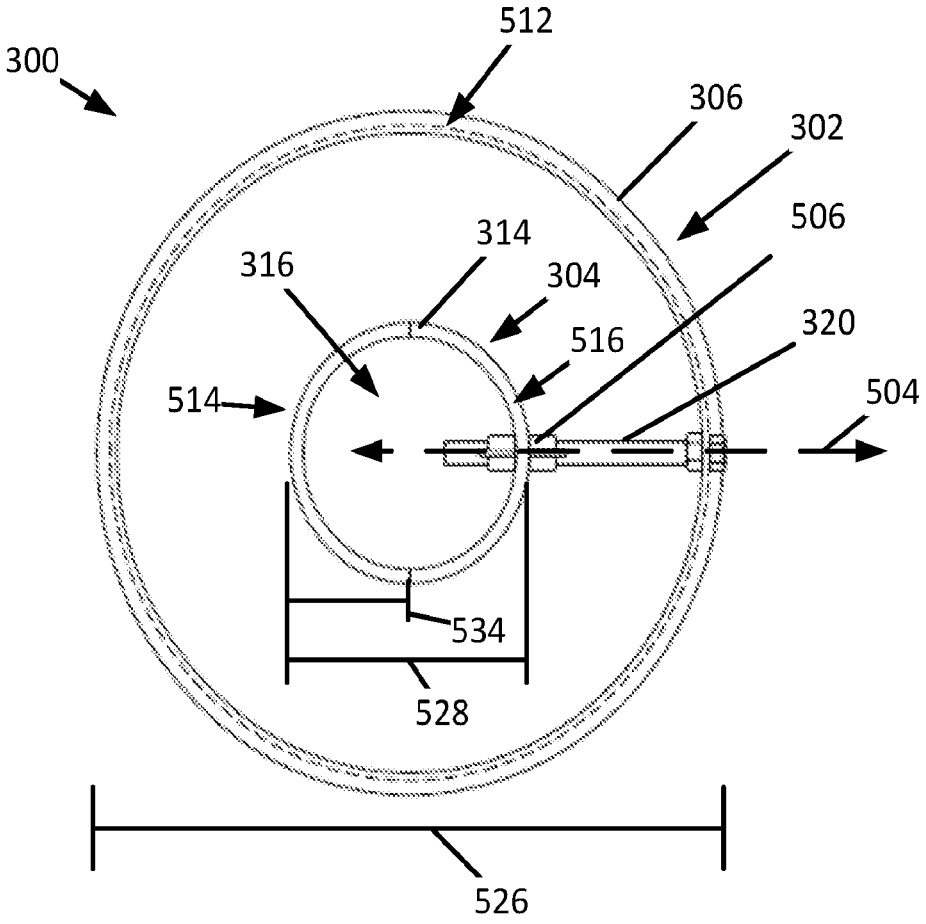
FIG. 5B shows a plan view of the scoring receptacle of FIG. 3, consistent with embodiments of the present disclosure.

FIG. 5A shows a cross-section of the scoring receptacle 300 taken along the line V-V of FIG. 4 and FIG. 5B shows a top view of the scoring receptacle 300. As shown, the second receptacle 304 may be coupled to the first receptacle 302 using the shaft 320. The shaft 320 may be received within an opening 502 extending through the second receptacle sidewall 314 such that at least a portion the shaft 320 extends into the second receptacle cavity 316. In some instances, the shaft 320 may be at least partially threaded. As such the shaft 320 may be capable of threadably engaging, for example, the opening 502. As such, a rotation of the shaft 320 may result in a movement of the second receptacle 304, relative to the first receptacle 302, along an axis 504 of the shaft 320. In some instances, the shaft 320 may not threadably engage the opening 502. For example, the shaft 320 may threadably engage one or more threaded couplings 506. As shown, a plurality of threaded couplings 506 may threadably engage the shaft 320 such that each threaded coupling 506 is positioned on opposing sides of the opening 502. To fix the position of the second receptacle 304, relative to the first receptacle 302, each threaded coupling 506 may engage (e.g., contact) opposing sides of the second receptacle sidewall 314. To adjust the position of the second receptacle 304, relative to the first receptacle 302, along the axis 504 of the shaft 320 each threaded coupling 506 may be spaced apart from opposing sides of the second receptacle sidewall 314. The threaded couplings 506 may be, for example, a nut and the shaft 320 may be, for example, a bolt.

The shaft 320 may be coupled to the first receptacle 302 at the first receptacle sidewall 306. As shown, the shaft 320 may be coupled to an opening 508 extending through the first receptacle sidewall 306. The shaft 320 may be coupled at the opening 508 extending through the first receptacle sidewall 306 using one or more of an adhesive, a press-fit, a snap-fit, a threaded coupling (e.g., a nut), one or more welds, and/or any other suitable form of coupling.

In some instances, the shaft 320 may be capable of rotating within the opening 508 extending through the first receptacle sidewall 306 without moving in a direction parallel to the axis 504 of the shaft 320. For example, the rotation of the shaft 320 may result in the movement of the second receptacle 304 relative to the first receptacle 302. In some instances, the opening 508 may be threaded for threadably engaging at least a portion of the shaft 320.

A separation distance 510 between the shaft 320 and an upper surface 512 of the first receptacle sidewall 306 may measure, for example, in a range of 5 centimeters (cm) to 30 cm. By way of further example, the separation distance 510 may measure in a range of 10 cm and 20 cm. By way of even further example, the separation distance 510 may measure in a range of 16 cm and 20 cm.

As also shown, the second receptacle 304 may include a cutout 514. The cutout 514 may extend from an upper surface 516 of the second receptacle sidewall 314 in a direction away from the second receptacle scoring end 318 and into the second receptacle cavity 316 by a cutout depth 534. As shown, the cutout 514 may have a cutout length 518 extending from the upper surface 516. The cutout length 518 may measure, for example, in a range of 5 cm to 20 cm. By way of further example, the cutout length 518 may measure in a range of 7 cm to 18 cm. By way of further example, the cutout length 518 may measure in a range of 10 cm to 15 cm.

In some instances, the cutout 514 may include an arcuate region 520. As shown, the arcuate region 520 may transition into a planar region 522. The planar region 522 may have a planar region length 524. The planar region length 524 may measure, for example, in a range of 1 cm to 10 cm. By way of further example, the planar region length 524 may measure in a range of 2 cm to 8 cm. By way of even further example, the planar region length 524 may measure in a range of 3 cm to 7 cm.

As shown, the first and second receptacles 302 and 304 each of have a circular cross-section. A first receptacle diameter 526 may measure, for example, in a range of 20 cm to 40 cm and the second receptacle diameter 528 may measure, for example, in a range of 5 cm to 20 cm. By way of further example, the first receptacle diameter 526 measure in a range of 25 cm to 35 cm and the second receptacle diameter 528 may measure in a range of 7 cm to 13 cm. A first receptacle height 530 may measure, for example, in a range of 25 cm to 45 cm. By way of further example, the first receptacle height 530 may measure in a range of 30 cm to 40 cm. As such, in some instances, the first receptacle 302 may generally be described as being a 18.92 liter bucket (i.e., a 5 gallon bucket). A maximum second receptacle height 532 may measure, for example, in a range of 25 cm to 45 cm. By way of further example, the maximum second receptacle height 532 may measure in a range of 30 cm to 40 cm. In some instances, the upper surface 512 of the first receptacle sidewall 306 may be substantially coplanar with (e.g., within manufacturing tolerances) the upper surface 516 of the second receptacle sidewall 314.

As shown in FIG. 5B the cutout depth 534 measures less than the second receptacle diameter 528. For example, a ratio of a measure of the cutout depth 534 to a measure of the second receptacle diameter 528 may be in a range of 1:6 to 5:6. By way of further example, a ratio of a measure of the cutout depth 534 to a measure of the second receptacle diameter 528 may be in a range of 1:3 to 2:3.

While the first and second receptacles 302 and 304 have been generally shown and described herein as being generally cylindrical in shape, such a configuration is non-limiting. For example, the first and second receptacles 302 and 304 may define a box having two or more sides. As such, the first and second receptacles 302 and 304 may have an elliptical cross-section, a triangular cross-section, a square cross-section, a rectangular cross-section, a trapezoidal cross-section, a pentagonal cross-section, an octagonal cross-section, and/or any other suitable cross-section. In some instances, the first and second receptacles 302 and 304 may each have a different cross-sectional shape.

Figure 6:
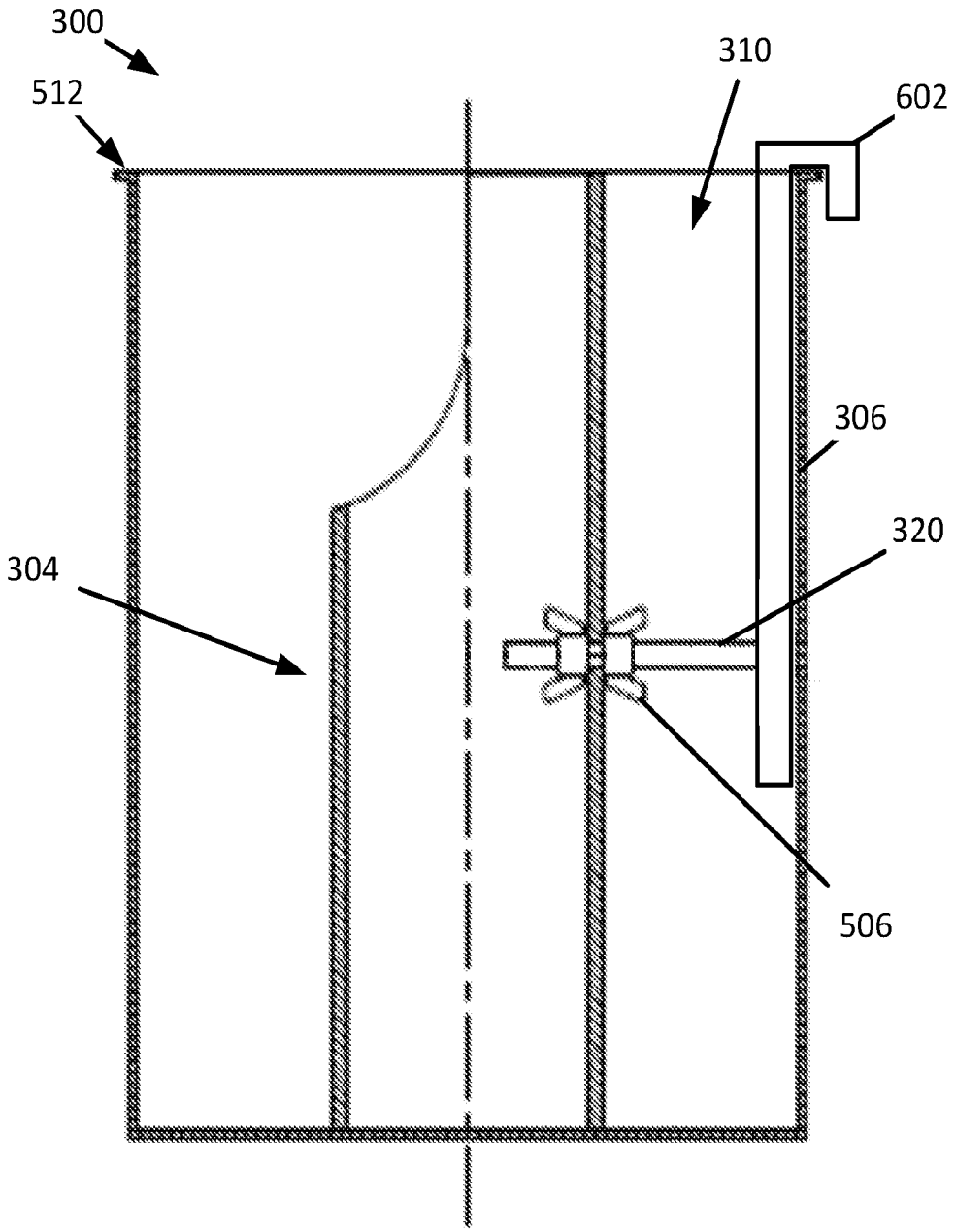
FIG. 6 shows a cross-section view of a scoring receptacle, consistent with embodiments of the present disclosure.

FIG. 6 shows a cross-section of an example of the scoring receptacle 300 of FIG. 4 having the shaft 320 coupled to a bracket 602. As shown, the bracket 602 may engage the upper surface 512 of the first receptacle sidewall 306 such that the shaft 320 is disposed with the first receptacle cavity 310. The second receptacle 304 may be coupled to the shaft 320 using, for example, the threaded couplings 506.

Figure 7:
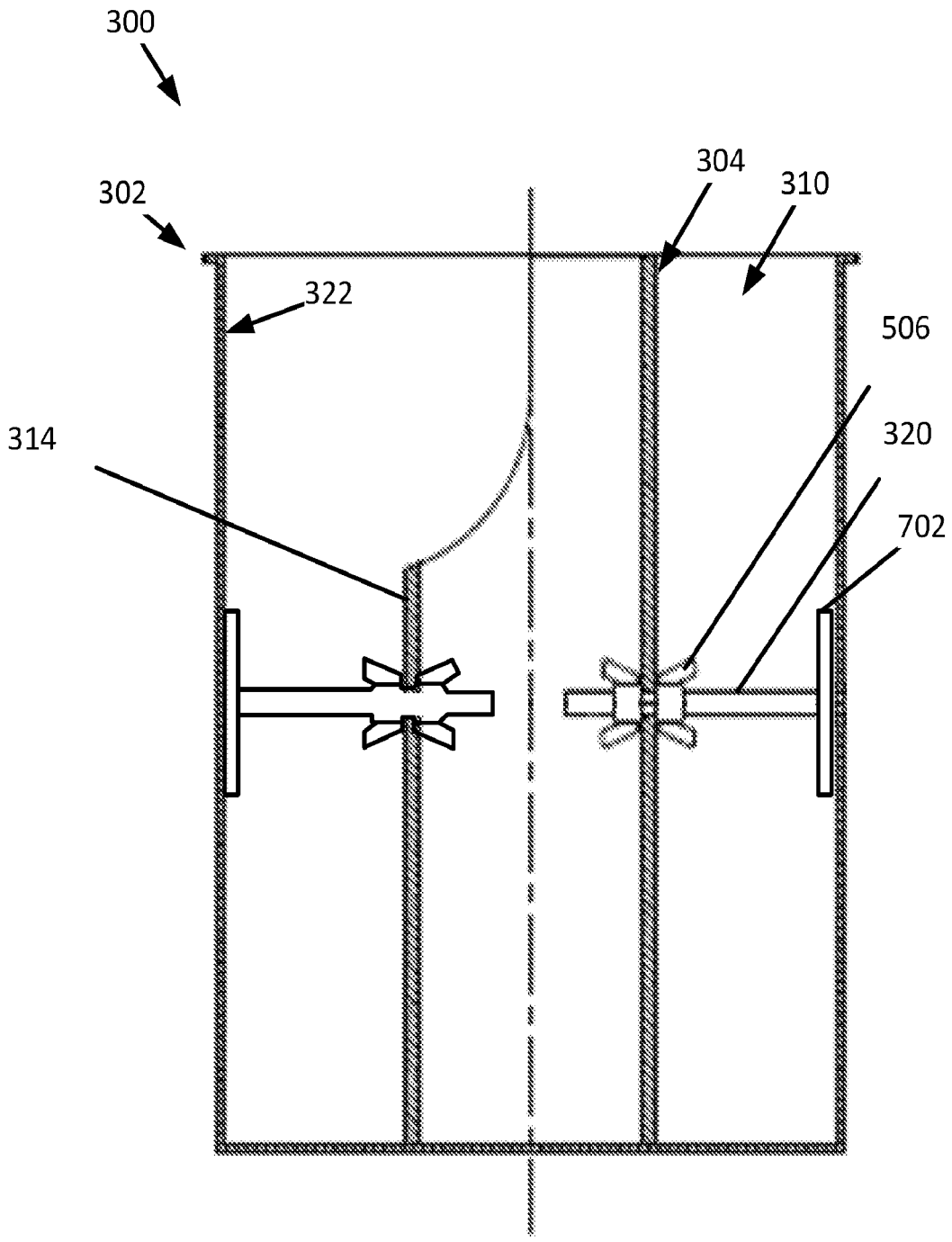
FIG. 7 shows another cross-section view of a scoring receptacle, consistent with embodiments of the present disclosure.

FIG. 7 shows a cross-section of an example of the scoring receptacle 300 of FIG. 4 having a plurality of shafts 320, each shaft 320 engaging (e.g., contacting) the inner surface 322 of the first receptacle 302. As shown, each shaft 320 may include and/or be coupled to an enlargement 702 that engages the inner surface 322 of the first receptacle 302. The engagement of the enlargement 702 with the inner surface 322 of the first receptacle 302 frictionally retains the second receptacle 304 within the first receptacle cavity 310. To adjust the position of the second receptacle 304 relative to the first receptacle 302 each of the threaded couplings 506 may be rotated such that each threaded coupling 506 is spaced apart from the second receptacle sidewall 314. When a desired position of the second receptacle 304 relative to the first receptacle 302 is obtained, each threaded coupling 506 may be rotated such that each threaded coupling 506 engages (e.g., contacts) the second receptacle sidewall 314.

Figure 8:
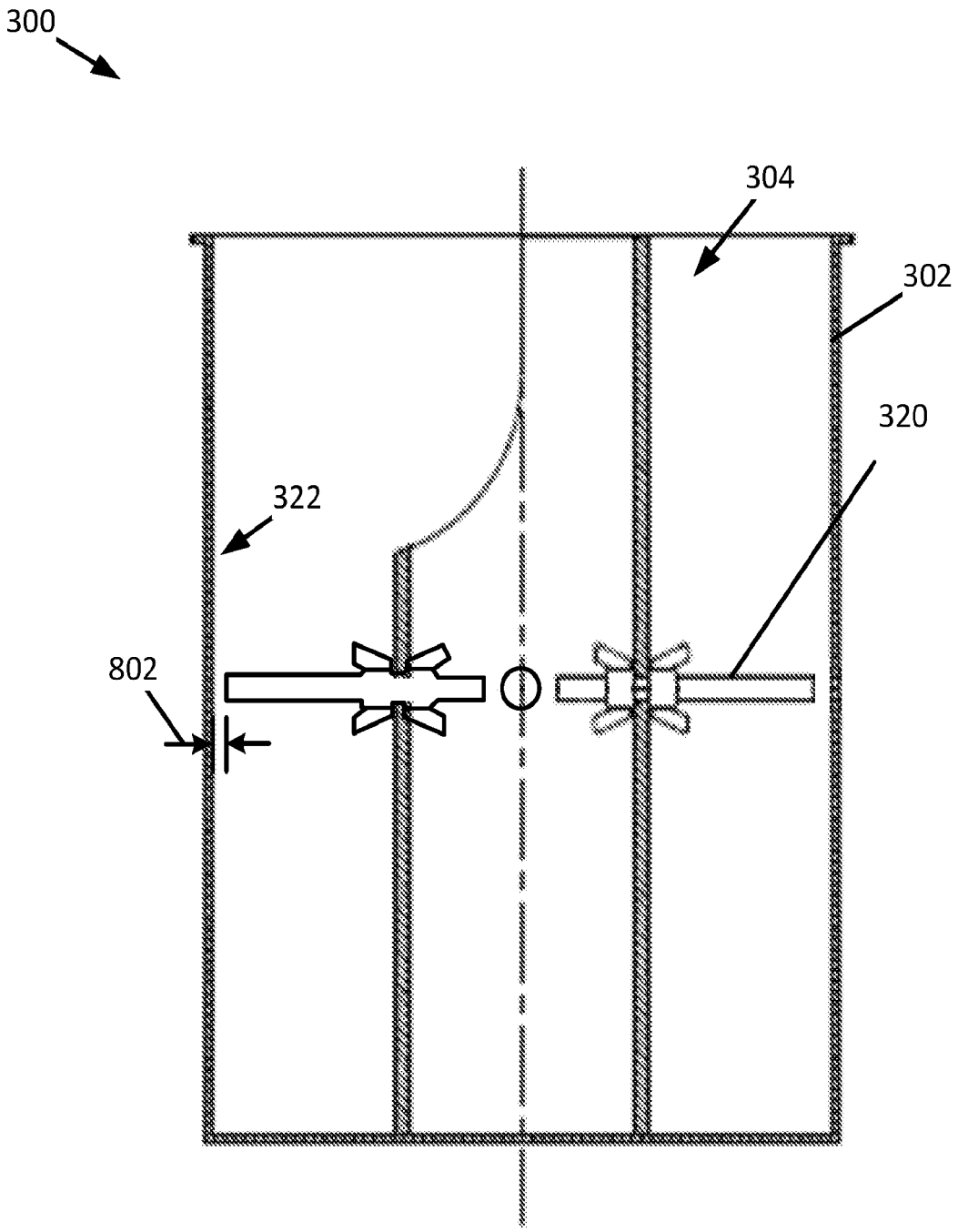
FIG. 8 shows another cross-section view of a scoring receptacle, consistent with embodiments of the present disclosure.
Figure 9:
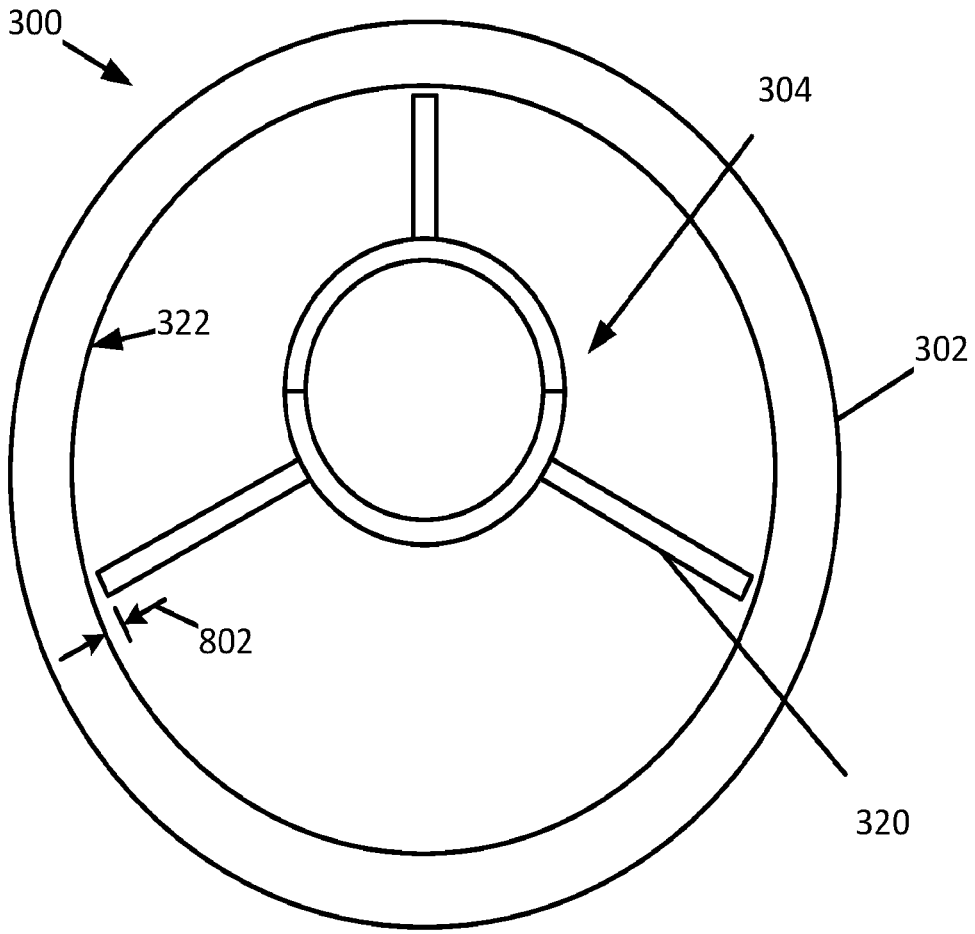
FIG. 9 shows a schematic plan view of the scoring receptacle of FIG. 8, consistent with embodiments of the present disclosure.

FIG. 8 shows a cross-section of an example of the scoring receptacle 300 of FIG. 4 having a plurality of shafts 320, each shaft 320 extending from the second receptacle 304 and being spaced apart from the inner surface 322 of the first receptacle 302 by a separation distance 802. FIG. 9 shows a top view of the scoring receptacle 300 of FIG. 8. The separation distance 802 may be selected such that the second receptacle 304 may rotate and/or tilt in response to an application of a force to the second receptacle 304. For example, when a projectile (e.g., the projectile 106) contacts the second receptacle 304, the second receptacle 304 may move. However, the shafts 320 may limit the amount of movement caused by the contact.

While the shaft 320 has generally been shown and described herein as being at least partially threaded, such a configuration is non-limiting. For example, the shaft 320 may be telescoping such that a length of the shaft 320 can be increased or decreased by extending the shaft 320. In some instances, the shaft 320 may include, for example, a track slideably engaging a rail such that a length of the shaft 320 can be increased or decreased by sliding the track along the rail. Therefore, the shaft 320 may have any configuration that allows the position of the second receptacle 304 relative to the first receptacle 302 to be adjusted.

Figure 10:
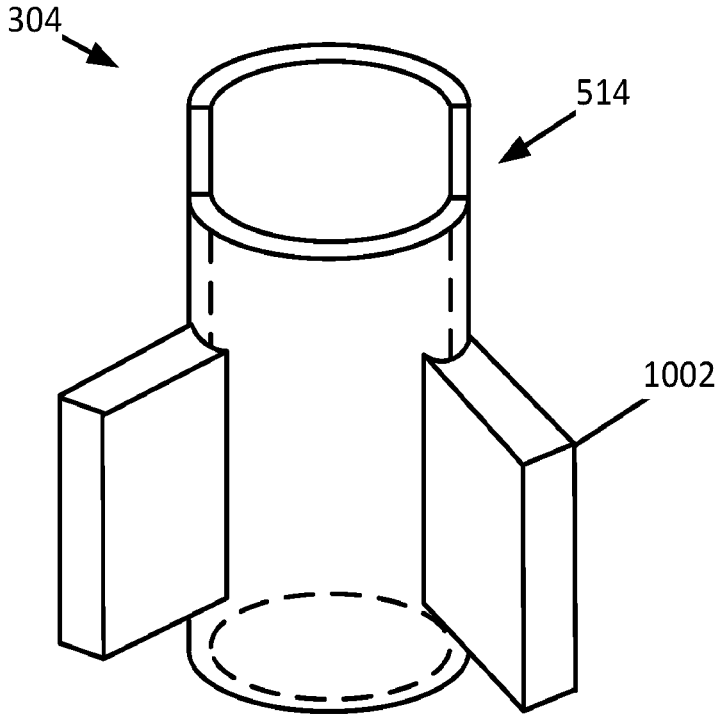
FIG. 10 shows a schematic perspective view of a second receptacle capable of being disposed within a first receptacle, consistent with embodiments of the present disclosure.

FIG. 10 shows an example of the second receptacle 304, wherein the shaft 320 is replaced with a plate 1002. In some instances, the second receptacle 304 may be rotatably coupled to the base 315 of the first receptacle 302 such that in response to the plate 1002 being contacted by a projectile (e.g., the projectile 106) the second receptacle 304 rotates relative to the first receptacle 302. As a result, the rotational position of the cutout 514 relative to the first receptacle 302 may change. In some instances, the second receptacle 304 may include at least one shaft 320 and at least one plate 1002.

Figure 11A:
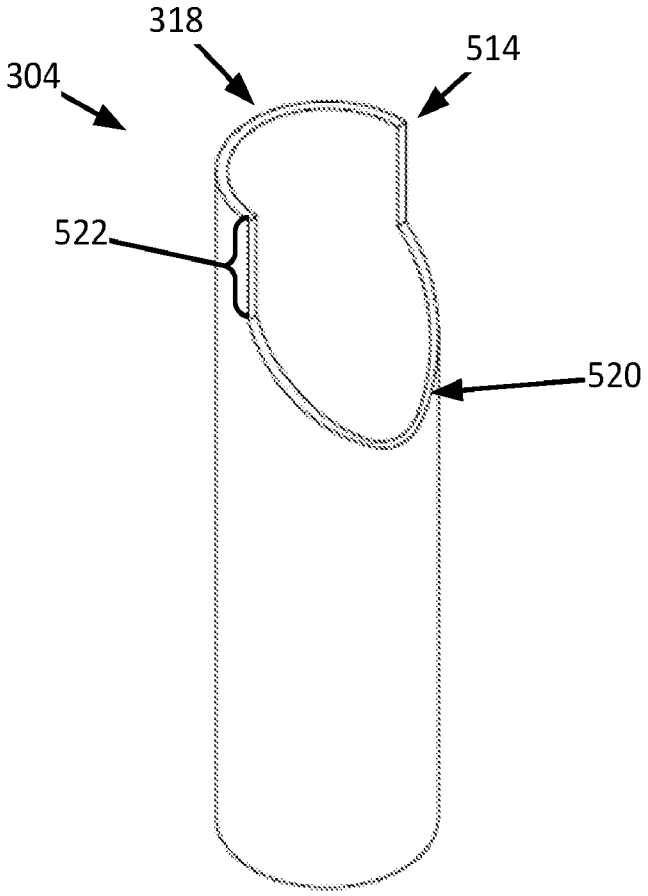
FIG. 11A shows a perspective view of a second receptacle capable of being disposed within a first receptacle, consistent with embodiments of the present disclosure.

FIG. 11A shows an example of the second receptacle 304. As shown, the arcuate region 520 may extend from the planar region 522 in a direction away from the second receptacle scoring end 318.

Figure 11B:
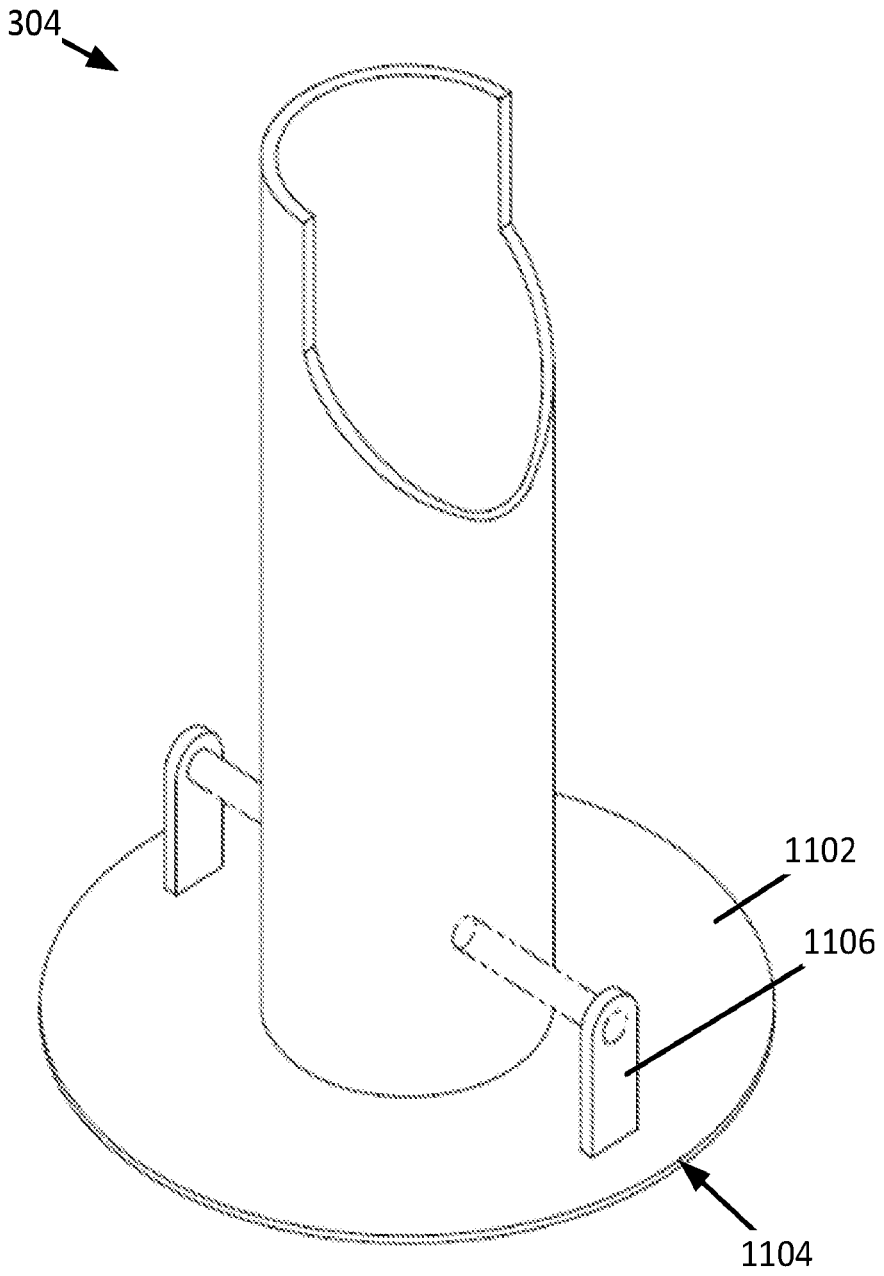
FIG. 11B shows a perspective view of a second receptacle capable of being disposed within a first receptacle, consistent with embodiments of the present disclosure.

FIG. 11B shows an example of the second receptacle 304, wherein the second receptacle 304 is coupled to a platform 1102. The platform 1102 may be received within the first receptacle cavity 310. In some instances, a peripheral edge 1104 of the platform 1102 may slidingly engage the inner surface 322 of the first receptacle 302. In other instances, the peripheral edge 1104 may be spaced apart from the inner surface 322 of the first receptacle 302 such that the position of the second receptacle 304 relative to the first receptacle 302 may be adjusted. For example, the platform 1102 may include one or more guides or rails that slidingly engage a corresponding guide or rail formed from and/or coupled to, for example, the base 315 of the first receptacle 302. The guides may be, for example, a slot or groove cut in the base 315 and the rails may be, for example, a threaded shaft (e.g., a bolt) and a threaded coupling (e.g., a nut). In some instances, the platform 1102 may slidingly engage the base 315 such that the second receptacle 304 is moveable along a plurality of axes relative to the first receptacle 302.

As shown, the second receptacle 304 may be coupled to the platform 1102 using one or more brackets 1106 extending from the platform 1102. However, such a configuration is non-limiting. For example, the second receptacle 304 may be coupled to the platform 1102 using one or more of an adhesive, a press-fit, a snap-fit, a threaded fastener (e.g., a bolt or a screw), one or more welds, and/or any other suitable form of coupling. While the platform 1102 is shown as being larger than the second receptacle 304, such a configuration is non-limiting. For example, one or more dimensions of the platform 1102 may measure less than or equal to a corresponding dimension of the second receptacle 304.

Figure 12:
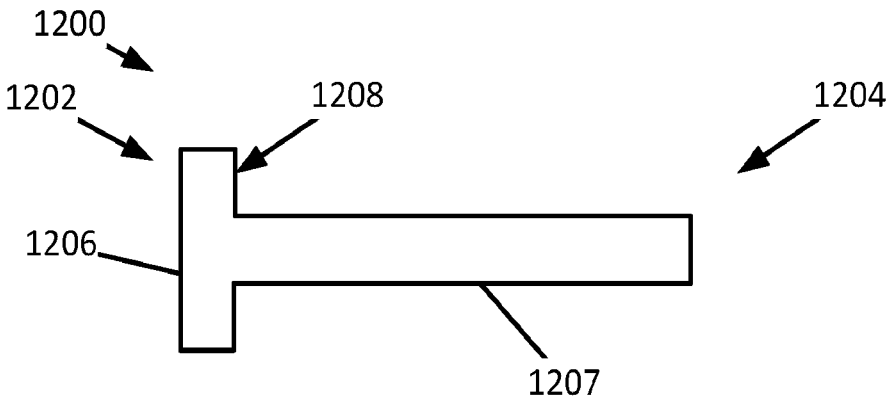
FIG. 12 shows a schematic plan view of a projectile capable of being used with the game of toss of FIG. 1, consistent with embodiments of the present disclosure.

FIG. 12 shows a schematic view of a projectile 1200, which may be one example of the projectile 106 of FIG. 1. The projectile 1200 may have a first end 1202 and a second end 1204, the first end 1202 being opposite the second end 1204. As shown, the first end 1202 may include an enlargement 1206 coupled to a body portion 1207 such that the body portion 1207 extends from the enlargement 1206. The enlargement 1206 may provide, for example, a gripping surface 1208 for a player of the game of toss 100. In some instances, the enlargement 1206 may be integrally (or monolithically) formed from the body portion 1207. In other instances, the enlargement 1206 may be coupled to the body portion 1207 using, for example, one or more of a snap-fit, a press-fit, an adhesive, a threaded fastener, one or more welds, and/or any other suitable form of coupling.

The enlargement 1206 may be removably coupled to the body portion 1207. For example, the enlargement 1206 may be weighted such that a location of a center of mass for the projectile 1200 can be changed by removing the enlargement. In some instances, enlargements 1206 having different masses may be used to change the location of the center of mass of the projectile 1200. This may allow, for example, the difficulty of the game of toss 100 to be adjusted based on a player's skill or preferences.

In some instances, at least a portion of the projectile 1200 may be magnetic (e.g., at least one of the enlargement 1206 or the body portion 1207 may be magnetic). As such, the projectile 1200 may be removed from a respective one of the first and second receptacles 302 and 304 using a magnet. Additionally, or alternatively, at least a portion of the projectile 1200 may include a portion of a hook and loop fastener. For example, the projectile 1200 may include a loop portion of the hook and loop fastener such that the projectile 1200 may be removed from a respective one of the first and second receptacles 302 and 304 using the hook portion of the hook and loop fastener.

The enlargement 1206 and the body portion 1207 may have any shape. For example, a cross-section of the enlargement 1206 and/or a cross-section of the body portion 1207 may be, for example, circle-shaped, rectangle-shaped, square-shaped, trapezoidal-shaped, pentagonal-shaped, hexagonal-shaped, or any other suitable shape. The cross-section of the enlargement 1206 and the cross-section of the body portion 1207 may each have a different shape.

The projectile 1200 may be formed of any one or more of a metal (e.g., an iron alloy, an aluminum alloy, a titanium alloy, and/or any other suitable metal or metal alloy), a plastic (e.g., polyethylene terephthalate, polyethylene, polyvinyl chloride, polycarbonate, and/or any other suitable plastic), a rubber (e.g., polybutadiene rubber, polychloroprene, isobutylene isoprene butyl, and/or any other suitable rubber), a polymeric foam (e.g., polystyrene foam, polyurethane foam, and/or any other suitable foam), a wood (e.g., oak, pine, maple, and/or any other suitable wood) and/or any other suitable material. In some instances, the projectile 1200 may be a bolt or nail.

The projectile 1200 may also be enclosed in an encasing material. For example, the projectile 1200 may be encased in one or more of a rubber (e.g., polybutadiene rubber, polychloroprene, isobutylene isoprene butyl, and/or any other suitable rubber), a polymeric foam (e.g., polystyrene foam, polyurethane foam, and/or any other suitable foam), and/or any other suitable material. By encasing the projectile 1200 within an encasing material, the risk of injury to other players of the game of toss 100 may be reduced. In some instances, encasing the projectile 1200 in a material may change the behavior of the projectile 1200 when thrown and/or when contacting the first and/or second receptacles 302 and 304.

While the projectile 1200 is generally shown and described as having the enlargement 1206 and the body portion 1207 extending therefrom, such a configuration is non-limiting. For example, the projectile 1200 may have a spherical-shape, a pyramidal-shape, a cube-shape, a cylindrical-shape, or any other suitable shape.

Figure 13:
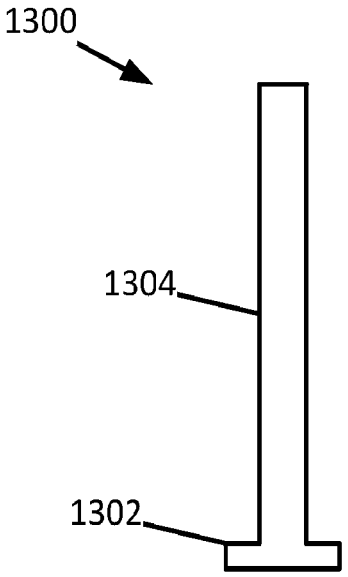
FIG. 13 shows a schematic plan view of a recovery tool for recovering the projectile of FIG. 12 from a scoring receptacle, consistent with embodiments of the present disclosure.

FIG. 13 shows a recovery tool 1300 having a projectile remover 1302 (e.g., a magnet or a portion of a hook and loop fastener) coupled to a shaft 1304 such that at least a portion of the shaft 1304 and the projectile remover 1302 are capable of extending within a respective one of the first and second receptacles 302 and 304 to remove the projectile 1200 therefrom. In some instances, the projectile remover 1302 may be pivotally coupled to the shaft 1304 using, for example, a ball joint such that the orientation of the projectile remover 1302 relative to the shaft 1304 may be adjusted to more easily remove one or more projectiles 1200 from the respective one of the first and second receptacles 302 and 304. In other instances, the projectile remover 1302 may be non-pivotally coupled to the shaft 1304. For example, the projectile remover 1302 may be coupled to the shaft 1304 using, for example, one or more of a snap-fit, a press-fit, an adhesive, a threaded fastener, one or more welds, and/or any other suitable form of coupling.

Figure 14:
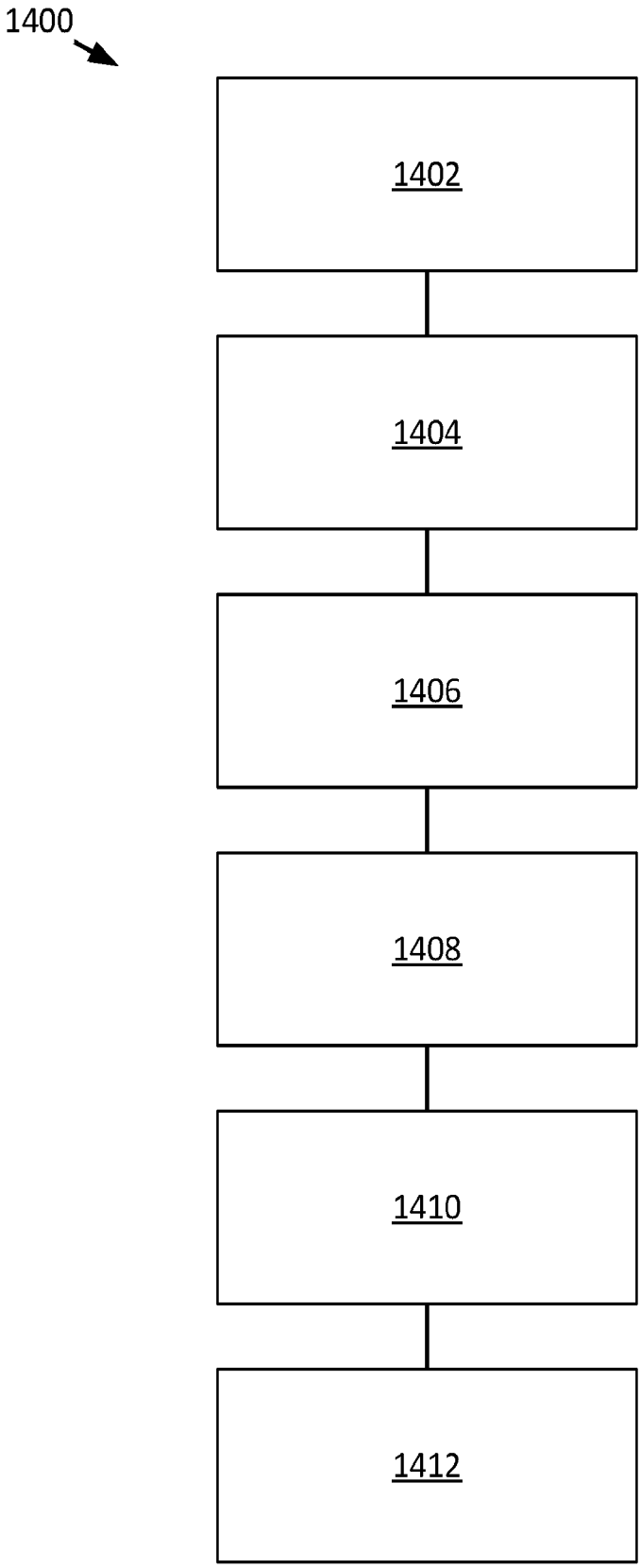
FIG. 14 is a method for playing the game of toss of FIG. 1, consistent with embodiments of the present disclosure.

FIG. 14 is a flowchart of a method for playing a game of toss 1400. The method for playing the game of toss 1400 may include setting up the scoring receptacle 1402, the scoring receptacle including a first and second receptacle. Setting up the scoring receptacle 1402 may include adjusting a location of the second receptacle relative to the first receptacle. The method for playing the game of toss 1400 may also include determining a starting position 1404. The starting position may represent the closest distance to the scoring receptacle that the player is able to stand prior to throwing a projectile. Determining the starting position 1404 may involve measuring a predetermined distance (e.g., in a range of 3 meters to 5 meters) from the scoring receptacle and designating the measured distance as the starting position. The method for playing the game of toss 1400 may also include determining an order of play 1406. The determining of the order of play 1406 may include spinning the projectile to be thrown on a surface (e.g., a floor) between the players, wherein the player at which the projectile is pointing, when the projectile stops spinning, is the player who throws, for example, first. This process may be repeated until each player is assigned an order of play. The method for playing the game of toss 1400 may also include throwing the projectile in a direction of the scoring receptacle 1408. The method for playing the game of toss 1400 may also include tallying a score based on where the thrown projectiles land relative to the scoring receptacle 1410. The method for playing the game of toss 1400 may also include removing the projectiles from the scoring receptacle 1412. When a player reaches a predetermined number of points, the game of toss may end.

Figure 15A:
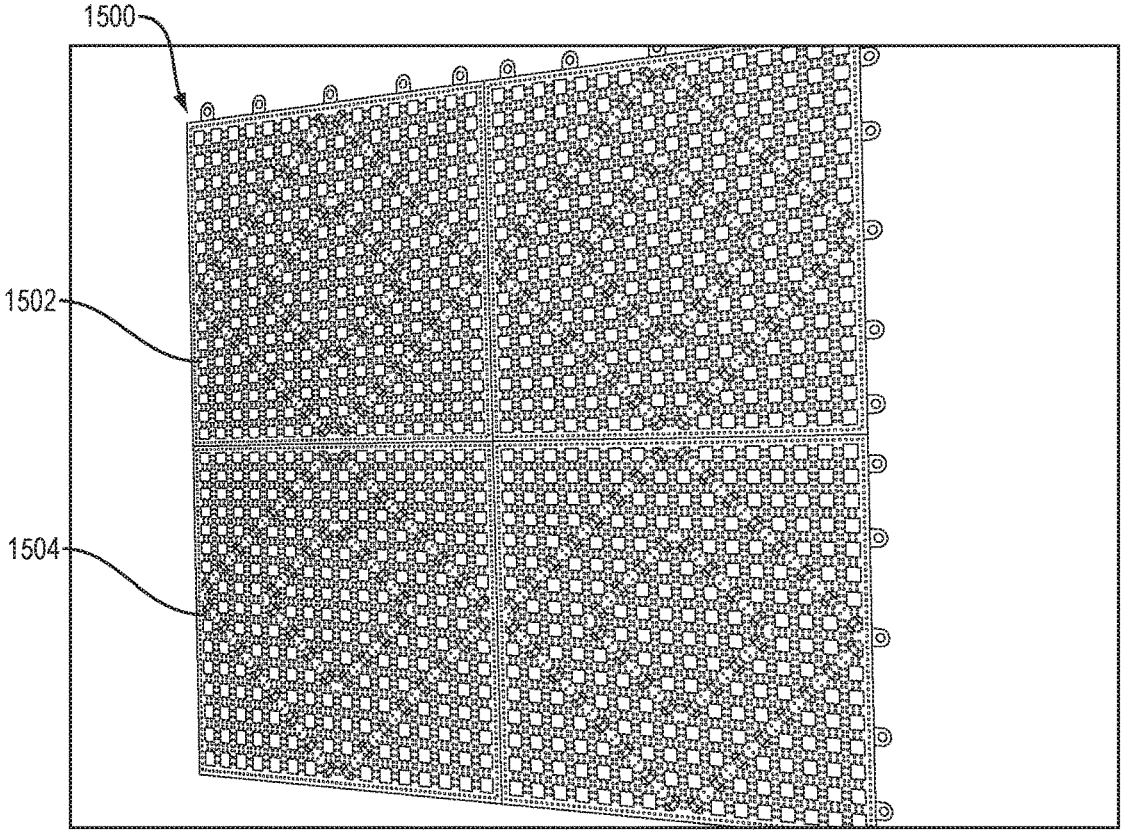
FIG. 15A shows a perspective view of a mat that may be used in the game of toss of FIG. 1, consistent with embodiments of the present disclosure.

FIG. 15A shows a perspective view of a mat 1500, which may be an example of the mat 107 of FIG. 1. As shown, the mat 1500 may include a plurality of openings 1502 extending through the mat 1500. As also shown, the mat 1500 may include multiple mat segments 1504. The mat segments 1504 may be interlocking such that the mat segments 1504 may be coupled together. While the mat 1500 is shown as having four interlocking mat segments 1504, such a configuration is not limiting. The mat 1500 may include any suitable number of mat segments 1504, for example, two, three, four, five, or six mat segments.

Figure 15B:
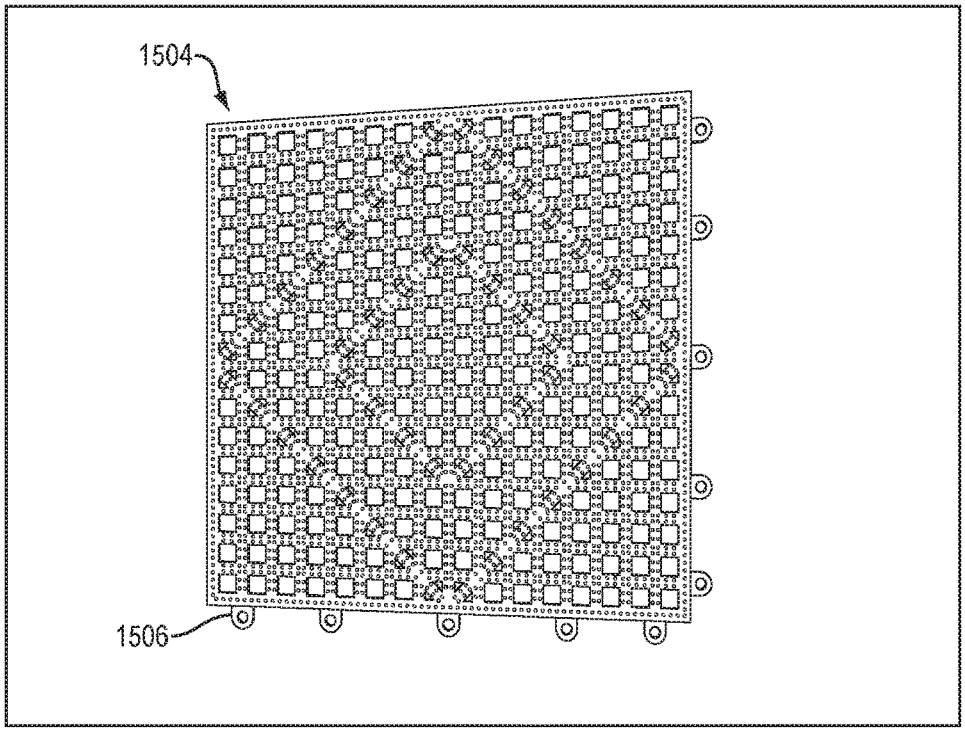
FIG. 15B shows a perspective view of a mat segment that may form part of the mat of FIG. 15A, consistent with embodiments of the present disclosure.

FIG. 15B shows a perspective view of the mat segment 1504. As shown, the mat segment 1504 may include one or more tabs 1506 extending from a peripheral edge of the mat segment 1504. Each of the one or more tabs 1506 may be configured to interlock with (e.g., engage) with a corresponding tab 1506 on an adjacent mat segment 1504. The dimensions of the mat segments 1504 may be selected such that each mat segment can be disposed within, for example, the first receptacle 302 of FIG. 3. In some instances, each mat segment 1504 may be flexible such that the mat segment 1504 may bend when disposed within the first receptacle 302. This may allow the overall dimensions of each mat segment 1504 to be increased relative to a rigid mat segment 1504. Therefore, for example, the mat segments 1504 may be made of an elastic material such as a rubber.

While the mat 1500 is generally shown as including a plurality of mat segments 1504, such a configuration is non-limiting. In some instances, the mat 1500 may be a unitary structure. In these instances, the mat 1500 may be flexible such that the mat 1500 may be disposed within the first receptacle 302.

According to one aspect of the present disclosure, there is provided a scoring system for a game of toss that may include a first receptacle having at least one first receptacle sidewall. The at least one first receptacle sidewall may define a first receptacle cavity. The scoring system may also include a second receptacle having at least one second receptacle sidewall. The at least one second receptacle sidewall may define a second receptacle cavity. The second receptacle may be configured to be disposed within the first receptacle cavity. A position of the second receptacle relative to the first receptacle may be adjustable.

According to another aspect of the present disclosure, there is provided a scoring system for a game of toss. The scoring system may include a first receptacle having at least one first receptacle sidewall. The at least one first receptacle sidewall may define a first receptacle cavity. The scoring system may also include a second receptacle having at least one second receptacle sidewall. The at least one second receptacle sidewall may define a second receptacle cavity. The second receptacle may be configured to be disposed within the first receptacle cavity. The second receptacle may include a cutout. The scoring system may also include a handle coupled to the first receptacle.

According to yet another aspect of the present disclosure, there is provided a scoring system for a game of toss. The scoring system may include a first receptacle having at least one first receptacle sidewall. The at least one first receptacle sidewall may define a first receptacle cavity. The scoring system may also include a second receptacle having at least one second receptacle sidewall. The at least one second receptacle sidewall may define a second receptacle cavity. The second receptacle may be disposed within the first receptacle cavity. An upper surface of the second receptacle sidewall may be substantially coplanar with an upper surface of the first receptacle sidewall.

According to yet another aspect of the present disclosure, there is provided a receptacle for a game of toss. The receptacle may include at least one receptacle sidewall, the at least one receptacle sidewall defining a receptacle cavity. The receptacle may also include a cutout extending from an upper surface of the receptacle sidewall and into the receptacle cavity. The receptacle may further include a shaft. The shaft may extend through an opening in the receptacle sidewall.

According to yet another aspect of the present disclosure, there is provided a receptacle for a game of toss. The receptacle may include at least one receptacle sidewall, the at least one receptacle sidewall defining a receptacle cavity. The receptacle may also include a cutout extending from an upper surface of the receptacle sidewall and into the receptacle cavity. The receptacle may further include an opening in the receptacle sidewall for receiving a shaft.

While several embodiments of the present disclosure have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present disclosure. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present disclosure is/are used.

Those skilled in the art will recognize, or be able to ascertain using no more than routine experimentation, many equivalents to the specific embodiments of the disclosure described herein. It is, therefore, to be understood that the foregoing embodiments are presented by way of example only and that, within the scope of the appended claims and equivalents thereto, the disclosure may be practiced otherwise than as specifically described and claimed. The present disclosure is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

What is claimed is:

1. A scoring system for a game of toss comprising:

a first receptacle having at least one first receptacle sidewall, the at least one first receptacle sidewall defining a first receptacle cavity;

a second receptacle having at least one second receptacle sidewall, the at least one second receptacle sidewall defining a second receptacle cavity, the second receptacle being configured to be disposed within the first receptacle cavity, wherein a position of the second receptacle relative to the first receptacle is adjustable, and wherein:

the second receptacle is coupled to the first receptacle using a shaft;

at least a portion the shaft extends into the second receptacle cavity through an opening in the second receptacle sidewall; and at least a portion of the shaft is threaded; and a plurality of threaded couplings, each threaded coupling threadably engaging the shaft on opposing sides of the opening.

2. The scoring system of claim 1, wherein the second receptacle further comprises a cutout.

3. The scoring system of claim 2, wherein the cutout extends from an upper surface of the second receptacle sidewall and into the second receptacle cavity.

4. The scoring system of claim 1, wherein an upper surface of the second receptacle sidewall is substantially coplanar with an upper surface of the first receptacle sidewall.

5. The scoring system of claim 1 further comprising a handle coupled to the first receptacle.

6. A scoring system for a game of toss comprising:

a first receptacle having at least one first receptacle sidewall, the at least one first receptacle sidewall defining a first receptacle cavity;

a second receptacle having at least one second receptacle sidewall, the at least one second receptacle sidewall defining a second receptacle cavity, the second receptacle being configured to be disposed within the first receptacle cavity, wherein the second receptacle includes a cutout; and a handle coupled to the first receptacle, wherein:

the second receptacle is adjustably coupled to the first receptacle; and the second receptacle is coupled to the first receptacle using a shaft, at least a portion of the shaft being threaded.

7. The scoring system of claim 6, wherein the cutout extends from an upper surface of the second receptacle sidewall and into the second receptacle cavity.

8. The scoring system of claim 6, wherein at least a portion of the shaft extends into the second receptacle cavity through an opening in the second receptacle sidewall.

9. The scoring system of claim 8 further comprising a plurality of threaded couplings, each threaded coupling threadably engaging the shaft on opposing sides of the opening.

10. The scoring system of claim 6, wherein an upper surface of the second receptacle sidewall is substantially coplanar with an upper surface of the first receptacle sidewall.

* * * * *